US007387374B2

(12) United States Patent
Kawamura

(10) Patent No.: US 7,387,374 B2
(45) Date of Patent: Jun. 17, 2008

(54) DROPLET EJECTION HEAD AND IMAGE RECORDING APPARATUS

(75) Inventor: Kazushige Kawamura, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 133 days.

(21) Appl. No.: 11/002,321

(22) Filed: Dec. 3, 2004

(65) Prior Publication Data

US 2005/0134657 A1 Jun. 23, 2005

(30) Foreign Application Priority Data

Dec. 5, 2003 (JP) ..... 2003-407876

(51) Int. Cl.
*B41J 2/045* (2006.01)
*B41J 29/393* (2006.01)

(52) U.S. Cl. ..... 347/72; 347/19

(58) Field of Classification Search ..... 347/14, 347/68–72, 19; 310/334
See application file for complete search history.

(56) References Cited

U.S. PATENT DOCUMENTS 4,034,380 A * 7/1977 Isayama ..... 347/19
4,469,978 A * 9/1984 Hamada et al. ..... 310/366
4,590,399 A * 5/1986 Roxlo et al. ..... 310/334
5,517,074 A * 5/1996 Van Pelt et al. ..... 310/328
2002/0113847 A1 8/2002 Takagi et al.

FOREIGN PATENT DOCUMENTS

| | | |
|---|---|---|
| JP | 55-118878 A | 9/1980 |
| JP | 56136671 | 10/1981 |
| JP | 63006238 | 1/1988 |
| JP | 63095948 | 4/1988 |
| JP | 63-122549 A | 5/1988 |
| JP | 04054325 | 2/1992 |
| JP | 6072635 | 3/1994 |
| JP | 63-31938 | 12/1994 |
| JP | 2002-159189 | 5/2002 |
| JP | 2002-254657 A | 9/2002 |

* cited by examiner

*Primary Examiner*—Stephen D. Meier
*Assistant Examiner*—Geoffrey Mruk
(74) *Attorney, Agent, or Firm*—Birch, Stewart, Kolasch & Birch, LLP

(57) ABSTRACT

The droplet ejection head comprises: a nozzle through which a droplet of liquid is ejected; a pressure chamber which is connected to the nozzle and filled with the liquid to be ejected through the nozzle; a diaphragm which defines a part of the pressure chamber; an electromechanical transducer which is deformed to drive the diaphragm to apply pressure to the liquid inside the pressure chamber so as to cause the droplet to be ejected through the nozzle; and a mechano-electrical transducer which determines oscillation state in the pressure chamber, wherein the electromechanical transducer and the mechanoelectrical transducer are arranged on the diaphragm in layers.

12 Claims, 9 Drawing Sheets

DROPLET EJECTION HEAD AND IMAGE RECORDING APPARATUS

BACKGROUND OF THE INVENTION

1. Field of the Invention

The present invention relates to a droplet ejection head and an image recording apparatus, and more specifically to a droplet ejection head and an image recording apparatus having an improved configuration of an electromechanical transducer and a mechanoelectrical transducer for determining oscillation in a pressure chamber of the droplet ejection head using piezoelectric elements.

2. Description of the Related Art

One known example of an image recording apparatus is an inkjet recording apparatus having an inkjet head (print head) with an array of multiple nozzles (image recording elements), in which an image is formed on a recording medium by ejecting ink from the nozzles while moving the inkjet head and the recording medium relative to each other.

There are various ink ejection systems for the inkjet head of such an inkjet recording apparatus. Known examples include a piezoelectric system in which a diaphragm defining a pressure chamber is deformed by the deformation of a piezoelectric element (piezoelectric ceramics) to vary the capacity of the pressure chamber, ink is introduced into the pressure chamber through an ink supply channel during the capacity increase of the pressure chamber, and the ink in the pressure chamber is ejected as droplets from a nozzle when the capacity of the pressure chamber decreases; and a thermal inkjet system in which the ink is heated to create air bubbles and is ejected by the energy of expansion when the air bubbles increase in size.

For example, an inkjet head that uses a piezoelectric element has a stacked structure formed by stacking on a substrate a piezoelectric element, a diaphragm, a flow path plate with an ink supply channel and a pressure chamber formed therein, and a nozzle plate (orifice plate) with an ink ejection hole formed therein.

In such an inkjet head that uses a piezoelectric element, when air sometimes gets mixed in the ink held in the head, the variation of the pressure chamber capacity is absorbed by the air bubbles formed by this air, so that sufficient pressure cannot be applied to the ink any longer, and ink ejection thus becomes incomplete. Moreover, ink droplets cannot be ejected when the nozzle is clogged with dirt or the like, or when the ink does not fill the pressure chamber. In such a case, the state of oscillation in the pressure chamber differs from that during normal ink droplet ejection. Various methods have been proposed for determining the state of oscillation in the pressure chamber in order to detect ink ejection failure or incomplete ejection.

Japanese Patent Application Publication No. 55-118878 discloses an ink injector including an ink chamber (pressure chamber), which has an ink supply port through which ink is supplied from an ink tank and an ink droplet ejection port through which the ink is atomized and ejected. Part of a wall surface defining the ink chamber is provided with a vibrator that is displaced and varies the capacity in the ink chamber in response to an electrical signal, and another part of the wall surface is provided with a detector for determining the displacement. When an abnormal displacement is detected by the detector, either the operator is informed so as to perform an air discharge operation, or an automatic air discharge operation for forcing a predetermined amount of ink out of the ink chamber and simultaneously discharge of the admixed air is performed, whereby the problem of ink ejection failure is resolved. However, this composition has problems in that a sufficient surface area is required for the mechanoelectrical transducer used for determination to be bonded onto the diaphragm, so that the surface area occupied by the electromechanical transducer used for drive must be decreased in proportion to the space to which the mechanoelectrical transducer used for determination is to be attached, which is inconvenient in terms of driving efficiency.

Japanese Patent Application Publication No. 63-122549 discloses that a drive pulse voltage is sent to all of a plurality of electromechanical transducers provided to the side wall of the ink chamber to eject ink from the ink chamber during the recording operation, and that during an abnormality detecting process, a determination pulse voltage not causing ink ejection is sent only to some of the plurality of electromechanical transducers, and the rest of the electromechanical transducers are switched so as to be connected to an abnormality determination circuit, whereby abnormalities such as the presence of air bubbles are detected by determining the oscillation state in the pressure chamber. However, this composition has problems in that since some of the plurality of electromechanical transducers are used as mechanoelectrical transducers for determination by the switching circuit, the determination sensitivity is insufficient because the oscillation generated by some of the electromechanical transducers is determined on the adjacent diaphragm, and furthermore, the electromechanical transducer cannot be used for drive and ink cannot be ejected during the abnormality detecting process.

SUMMARY OF THE INVENTION

The present invention has been contrived in view of such circumstances, and an object thereof is to provide a droplet ejection head and image recording apparatus comprising an oscillation determining mechanism wherein the determination sensitivity is increased, and determination is possible even during driving, without decreasing the surface area occupied by the electromechanical transducer used for drive.

In order to attain the aforementioned object, the present invention is directed to a droplet ejection head, comprising: a nozzle through which a droplet of liquid is ejected; a pressure chamber which is connected to the nozzle and filled with the liquid to be ejected through the nozzle; a diaphragm which defines a part of the pressure chamber; an electromechanical transducer which is deformed to drive the diaphragm to apply pressure to the liquid inside the pressure chamber so as to cause the droplet to be ejected through the nozzle; and a mechanoelectrical transducer which determines oscillation state in the pressure chamber, wherein the electromechanical transducer and the mechanoelectrical transducer are arranged on the diaphragm in layers.

According to the present invention, the determination sensitivity is increased, it is possible to determine the oscillation state in the pressure chamber even while the droplet ejection head is driven to eject droplets, and the surface area occupied by the electromechanical transducer for drive the diaphragm is not decreased.

Preferably, each of the electromechanical transducer and the mechanoelectrical transducer comprises a plurality of layers.

The electromechanical transducer and the mechanoelectrical transducer may be made of the same material, so that green sheets can be used, and configuration can be achieved with the connection of the electrodes between the layers.

Alternatively, the electromechanical transducer and the mechanoelectrical transducer may be made of different materials, so that elements with good conversion efficiency for drive and determination, respectively, can be used by bonding them.

Preferably, the droplet ejection head further comprises a circuit-switching device which switches the mechanoelectrical transducer to be utilized as an electromechanical transducer for driving the diaphragm. Thus, switching the element usually used for determination to driving makes possible to increase ejection force and perform recovery operation when the nozzles are clogged.

Preferably, the droplet ejection head further comprises an evaluation device which performs evaluation of a condition in the pressure chamber from a wave pattern determined by the mechanoelectrical transducer, wherein a recovery operation for the droplet ejection head is performed according to a result of the evaluation. Evaluating the conditions in the pressure chamber makes it possible to perform optimal recovery operation according to the conditions at that time.

In order to attain the aforementioned object, the present invention is also directed to an image recording apparatus, comprising the aforementioned droplet ejection head. Thus, abnormalities can be detected during image recording by using the droplet ejection head in the image recording apparatus, and it is therefore possible to preserve the quality of the outputted prints.

As described above, with the droplet ejection head and image recording apparatus according to the present invention, the drive efficiency is maintained without decreasing the surface area occupied by the electromechanical transducer used for drive, the determination sensitivity of the mechanoelectrical transducer used for determination is increased, and it is also possible to determine the oscillation state in the pressure chamber even when the heads are being driven.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
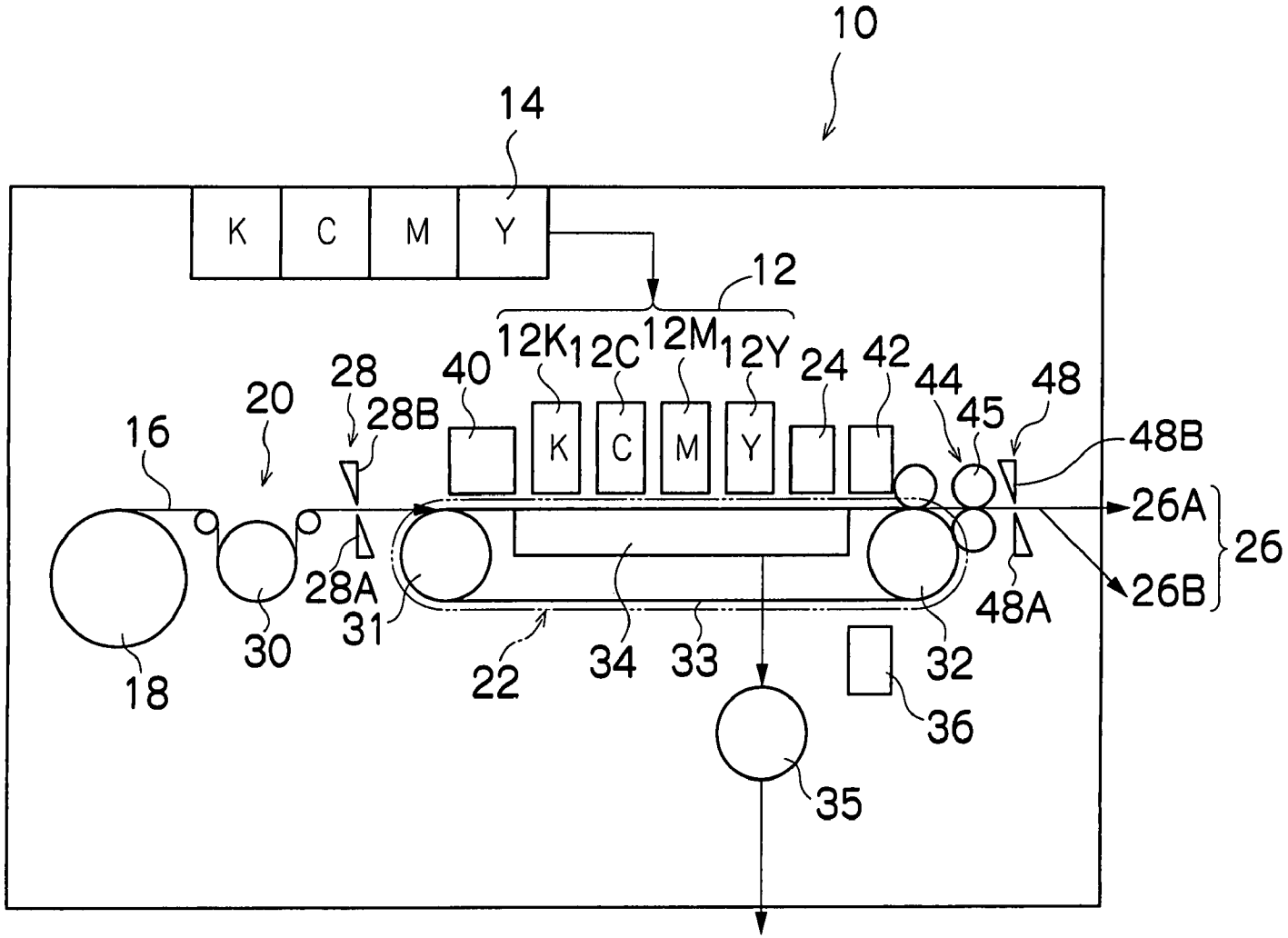
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of droplet ejection heads or print heads 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The printing unit 12 forms a so-called full-line head in which a line head having a length that corresponds to the maximum paper width is disposed in the main scanning direction perpendicular to the delivering direction of the recording paper 16. Each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10.

The print heads 12K, 12C, 12M, and 12Y are arranged in this order from the upstream side (the left-hand side in FIG. 1) along the delivering direction of the recording paper 16 (hereinafter referred to as the paper conveyance direction). A color print can be formed on the recording paper 16 by ejecting the inks from the print heads 12K, 12C, 12M, and 12Y, respectively, onto the recording paper 16 while conveying the recording paper 16.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added. Moreover, a configuration is possible in which a single print head adapted to record an image in the colors of CMY or KCMY is used instead of the plurality of print heads for the respective colors.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

As shown in FIG. 1, the ink storing/loading unit 14 has tanks for storing the inks to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed with the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming in contact with ozone and other substances that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, a sorter for collecting prints according to print orders is provided to the paper output unit 26A for the target prints.

Next, the structure of the droplet ejection heads or the print heads is described. The print heads 12K, 12C, 12M, and 12Y provided for the respective ink colors have the same structure, and a reference numeral 50 is hereinafter designated to any of the print heads 12K, 12C, 12M, and 12Y.

Figure 2:
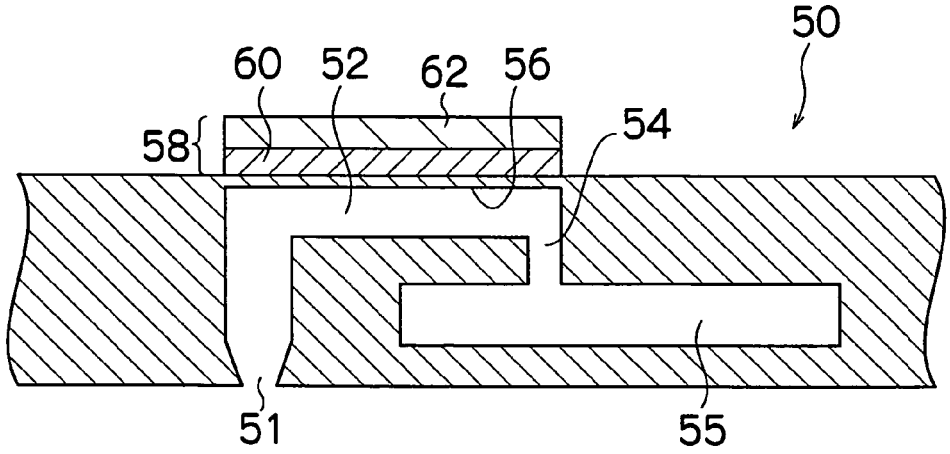
FIG. 2 is a cross-sectional view showing the principal components of a print head.

As shown in FIG. 2, each print head 50 of the present embodiment has a pressure chamber 52 for applying pressure to the ink to eject the ink as droplets through the nozzle 51. The pressure chamber 52 is disposed at a position corresponding to the nozzle 51 and in communication with the nozzle 51. The planar shape of the pressure chamber 52 as seen from the upper side of the drawing is substantially square, and the nozzle 51 and an ink supply port 54 are disposed at portions that correspond to diametrically opposite corners. The pressure chamber 52 is communicated with a common flow channel 55 via the supply port 54.

A piezoelectric element (actuator) 58 is arranged on the top of a diaphragm (pressure plate) 56 constituting one surface (the upper surface in the drawing) of the pressure chamber 52. The piezoelectric element 58 is configured with a layered structure composed of an electromechanical transducer 60 for driving the diaphragm 56, and a mechanoelectrical transducer 62 for determining the state of oscillation in the pressure chamber 52.

In each print head 50 configured in this manner, a drive voltage is applied to the electromechanical transducer 60 for drive formed on the diaphragm 56 so as to deform the electromechanical transducer 60, the capacity of the pressure chamber 52 is thereby reduced, and the ink is thus ejected from the nozzle 51 as ink droplets. When the ink is ejected, new ink is supplied to the pressure chamber 52 from the common flow channel 55 through the supply port 54.

Thus, by forming a layered structure composed of the piezoelectric elements for drive and the piezoelectric elements for determination in the print heads (droplet ejection heads) of the present embodiment, the drive efficiency is maintained, the determination sensitivity of the mechanoelectrical transducer used for determination is increased, and it is also possible to determine the oscillation state even while the heads are being driven, without decreasing the area occupied by the driving piezoelectric element (electromechanical transducer) on the diaphragm.

Figure 3A:
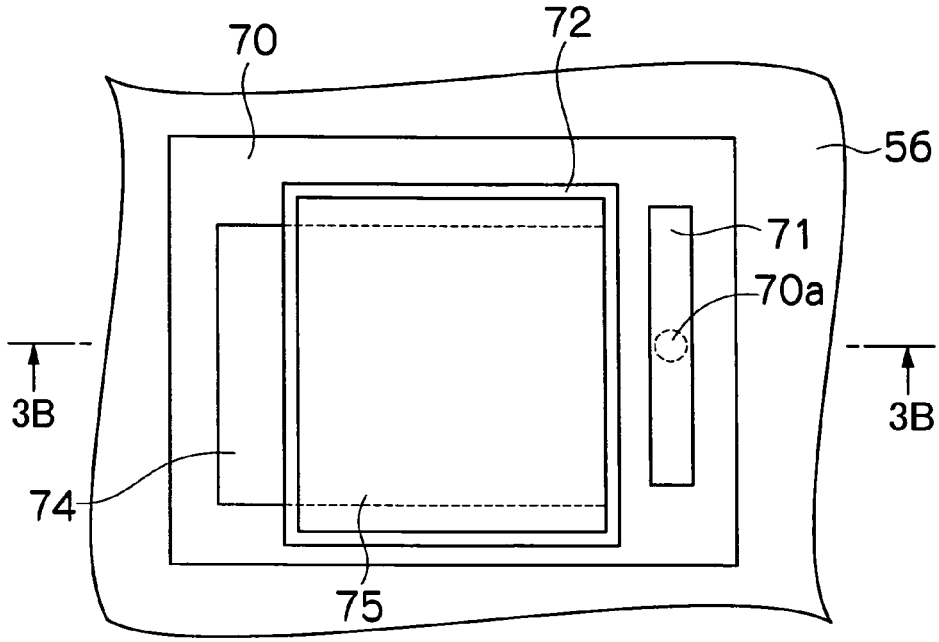
FIGS. 3A and 3B are explanatory drawings showing an example in which each of an electromechanical transducer and a mechanoelectrical transducer is configured from one layer.
Figure 3B:
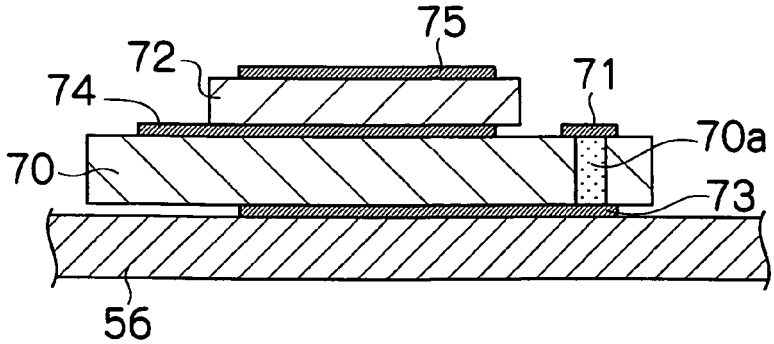

The layered structure of the piezoelectric element will now be described in further detail. FIGS. 3A and 3B show an example in which one layer composed of a mechanoelectrical transducer, which is a piezoelectric element for determination, is superposed on one layer of an electromechanical transducer, which is a piezoelectric element for drive. FIGS. 3A and 3B show only the portion above the diaphragm 56, FIG. 3A is a plan view, and FIG. 3B is a cross-sectional view along the line 3B-3B in FIG. 3A.

As shown in FIGS. 3A and 3B, in this example, one layer each of an electromechanical transducer 70 for drive as a bottom layer and a mechanoelectrical transducer 72 for determination as a top layer are stacked on the diaphragm 56. An electromechanical transducer electrode 73 is provided as a lower electrode between the electromechanical transducer 70 constituting the bottom layer and the diaphragm 56, a common electrode 74 is provided between the electromechanical transducer 70 and the mechanoelectrical transducer 72, and a mechanoelectrical transducer electrode 75 is provided as an upper electrode on top of the mechanoelectrical transducer 72. A through-hole 70*a* is provided in the electromechanical transducer 70 constituting the bottom layer, and conductive material is filled into the through-hole 70*a* and brought in contact with external wiring 71.

The electromechanical transducer 70 is arranged between the common electrode 74 and the electromechanical transducer electrode 73, and they constitute a capacitor. The mechanoelectrical transducer 72 is arranged between the mechanoelectrical transducer electrode 75 and the common electrode 74, and they constitute a capacitor.

The electromechanical transducer 70 can be deformed and ink droplets can be ejected by applying a voltage between the common electrode 74 and the electromechanical transducer electrode 73. Also, the oscillation state can be determined by picking up the electrical charge generated by the deformation of the mechanoelectrical transducer 72 through the mechanoelectrical transducer electrode 75.

Although the electromechanical transducer 70 and the mechanoelectrical transducer 72 may be made of the same material, they are preferably made of different piezoelectric elements bonded together. More specifically, it is preferable that the piezoelectric element for drive constituting the bottom layer is made of a material with high conversion efficiency from electrical to mechanical (drive efficiency), such as one that moves a significant distance with a small amount of electricity, and that the piezoelectric element for determination constituting the top layer is made of a material with a high conversion efficiency from mechanical to electrical (sensor efficiency), such as one in which a large amount of electricity is generated with little displacement. For example, lead zirconate titanate $Pb(Zr—Ti)O_3$, commonly referred to as PZT, has a basic composition of ferroelectric lead titanate $PbTiO_3$ and antiferroelectric lead zirconate $PbZrO_3$. Since piezoelectricity, dielectricity, elasticity, and other characteristics can be controlled by varying the mixture ratio of these two components, piezoelectric ceramic materials with improved conversion efficiency can be obtained. Piezoelectric elements of different materials may be bonded, and polyvinylidene fluoride is an example of a substance with good sensor efficiency used for determination.

Also, the example given above is a layered configuration in which the bottom layer is a piezoelectric element for drive and the top layer is a piezoelectric element for determination, but the layered configuration is not limited to such an arrangement, and it is possible to reverse this layered configuration depending on the properties of the piezoelectric elements used.

Figure 4A:
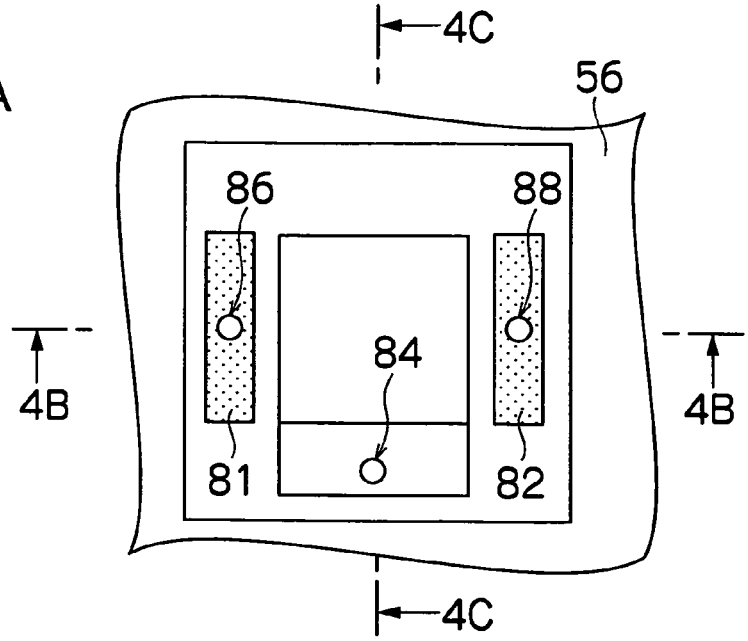
FIGS. 4A to 4C are explanatory drawings showing an example in which each of an electromechanical transducer and a mechanoelectrical transducer is configured from multiple layers.
Figure 4B:
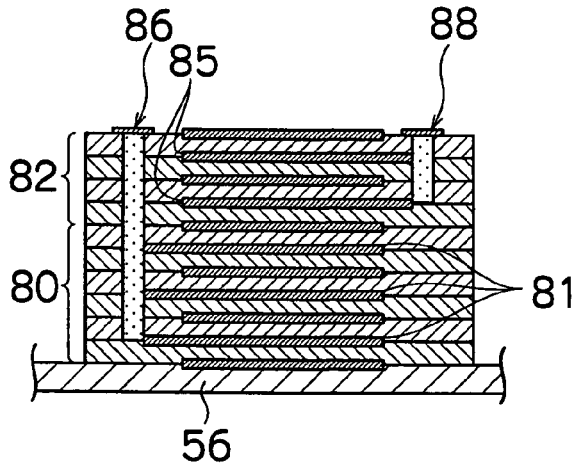
Figure 4C:
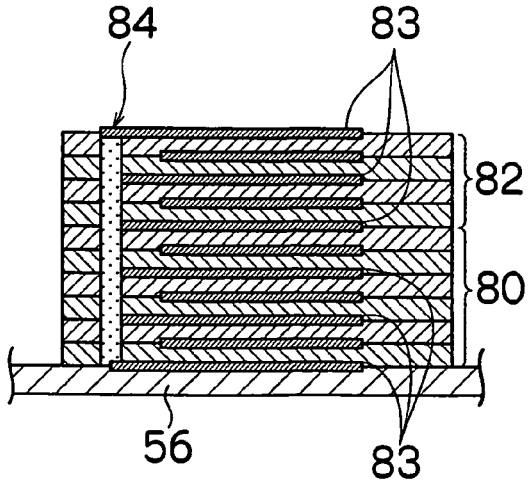

Next, FIGS. 4A, 4B, and 4C show an example in which a plurality of piezoelectric elements for drive and a plurality of piezoelectric elements for determination are stacked on the diaphragm 56. FIG. 4A is a plan view of the portion above the diaphragm 56, FIG. 4B is a cross-sectional view along the line 4B-4B in FIG. 4A, and FIG. 4C is a cross-sectional view along the line 4C-4C in FIG. 4A.

As shown in FIGS. 4B and 4C, in this example, an electromechanical transducer 80 for drive is formed by six layers of piezoelectric sheets (green sheets) on the diaphragm 56, and a mechanoelectrical transducer 82 for determination is formed thereon by four layers of piezoelectric sheets (green sheets). Each of the layers constituting the electromechanical transducer 80 is arranged between an electromechanical transducer electrode (drive electrode) 81 and a common electrode 83, and they constitute a capacitor. Each of the layers constituting the mechanoelectrical transducer 82 is arranged between a mechanoelectrical transducer electrode (drive electrode) 85 and a common electrode 83, and they constitute a capacitor.

Through-holes 84, 86, and 88 are formed in the layers as shown in the drawings, and the through-holes are filled with conductive material to form wiring to the electrodes. More specifically, wiring to the common electrodes 83 is formed in the through-hole 84 as shown in FIG. 4C, wiring to the electromechanical transducer electrodes 81 is formed in the through-hole 86, and wiring to the mechanoelectrical transducer electrodes 85 is formed in the through-hole 88, as shown in FIG. 4B.

Though not shown in the drawings, the common electrode 83 for the electromechanical transducer electrode 81 and the mechanoelectrical transducer electrode 85 is disposed on the top surface and is bonded to a wiring board such as a flexible cable board. Thus, the piezoelectric elements for drive and the piezoelectric elements for determination are formed in a layered structure with a stack of green sheets, and the electrodes between the layers are connected, to configure the electromechanical transducer 80 and the mechanoelectrical transducer 82.

In this example as well, the lower layers of the piezoelectric element layers formed on the diaphragm 56 are the electromechanical transducer 80 for drive, and the upper layers thereof are the mechanoelectrical transducer 82 for determination, but the arrangement of these upper and lower layers is not limited thereto and may be reversed. Furthermore, if there are a plurality of layers for each of the elements for drive and the elements for determination, the element layers for drive and the element layers determination may be disposed to alternate by one layer each.

Figure 5A:
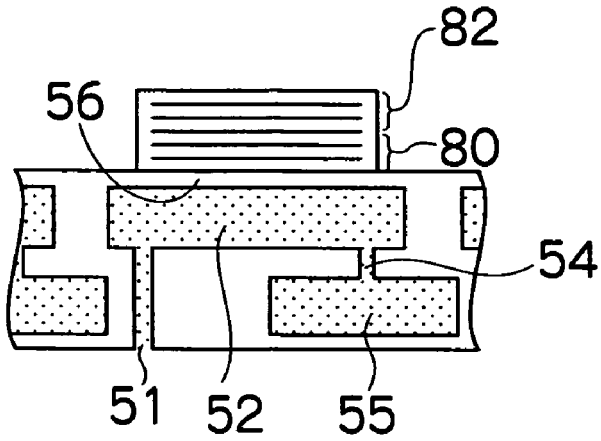
FIGS. 5A and 5B are explanatory drawings showing the print head during drive.
Figure 5B:
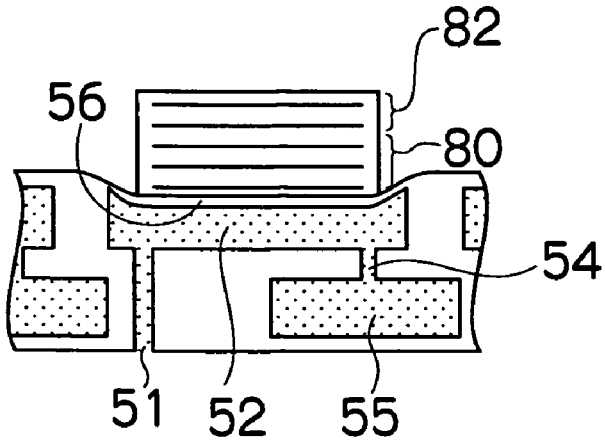

FIGS. 5A and 5B show the states during driving. FIG. 5A shows the state of a voltage of 0 volts (V) being applied to the electromechanical transducer 80 for drive, and FIG. 5B shows the state of a voltage of E (V) being applied to the electromechanical transducer 80 for drive. As shown in FIG. 5B, applying the voltage E (V) causes the electromechanical transducer 80 to expand in the vertical directions of the drawing, the diaphragm 56 to be pressed and deform downward, and the capacity of the pressure chamber 52 to decrease, whereby ink is ejected from the nozzle 51.

The mechanoelectrical transducer 82 for determination meanwhile determines the deformation of the diaphragm 56 due to the oscillation of ink or air or the like in the pressure chamber 52. More specifically, an electrical charge is generated in the mechanoelectrical transducer 82 according to the deformation of the diaphragm 56 due to oscillation in the pressure chamber 52, and picking up this electrical charge makes it possible to determine the oscillation state in the pressure chamber 52 caused by the deformation of the diaphragm 56.

Figure 6A:
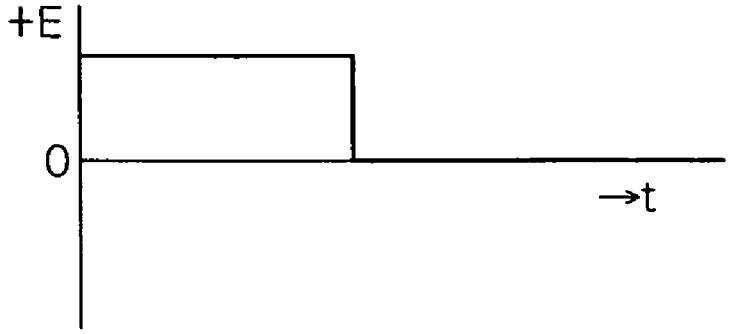
FIGS. 6A to 6D are explanatory drawings showing the displacement of the diaphragm differing under the conditions in a pressure chamber when the print head is driven.
Figure 6B:
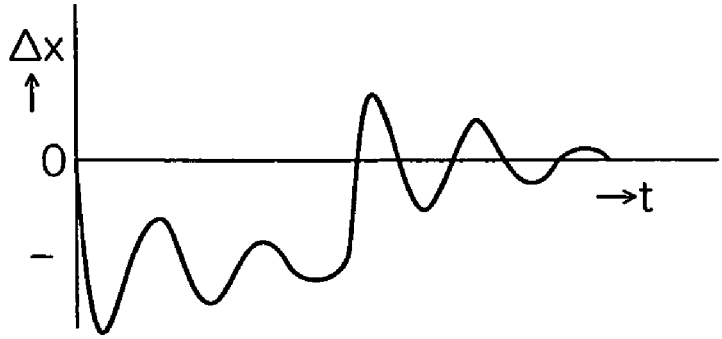
Figure 6C:
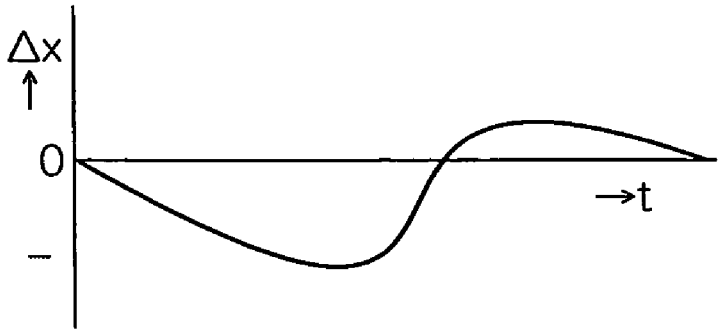
Figure 6D:
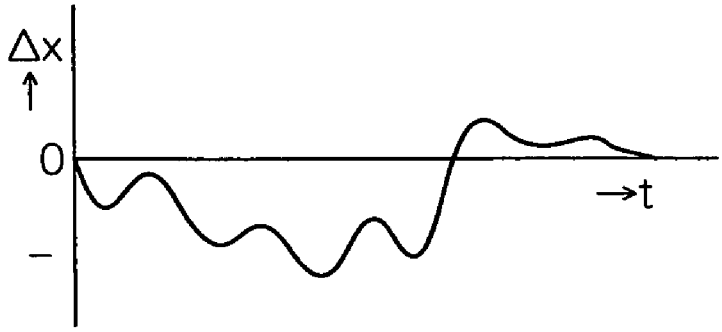

FIGS. 6A, 6B, 6C, and 6D show the details of the signals concerning the state determination. FIG. 6A shows the wave pattern of the electrical signal inputted to the electromechanical transducer 80 for drive, specifically the voltage signal. FIGS. 6B, 6C, and 6D show the displacement Ax of the diaphragm 56 that corresponds to the oscillation states.

FIG. 6B shows the displacement of the diaphragm 56 during normal times when ink is filled in the pressure chamber 52, the nozzle 51, the common flow channel 55, and the like, and air is not mixed in. FIG. 6C shows the displacement of the diaphragm 56 that occurs when the pressure chamber 52 is not filled with ink and only air is present due to clogging or the like at the supply side. FIG. 6D shows the displacement of the diaphragm 56 that occurs when ink is present in the pressure chamber 52 but air is also mixed in. In FIG. 6D, the bubbles produced by the admixed air act as a damper to absorb oscillation, and the applied pressure is not accurately transferred to the ink, so that the ink cannot be normally ejected.

Figure 7A:
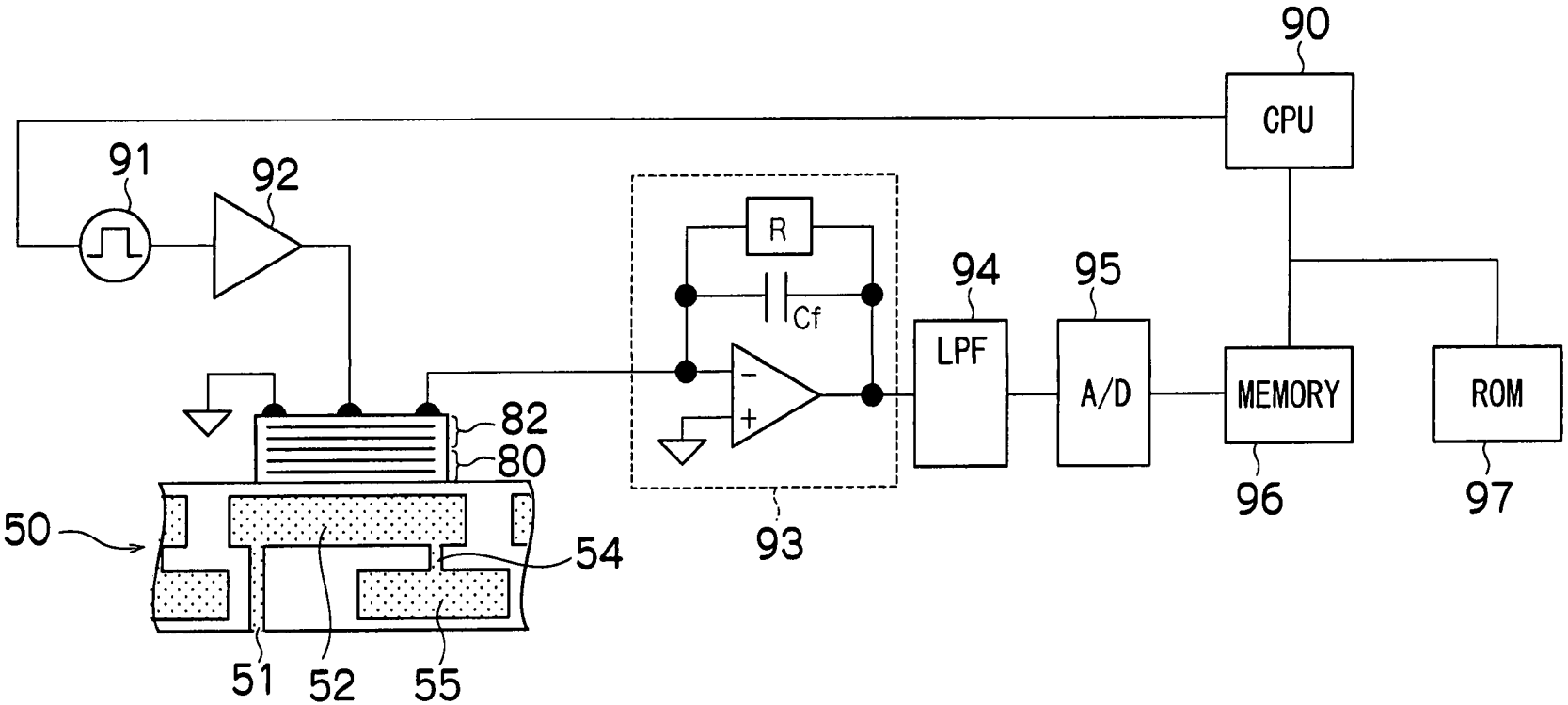
FIGS. 7A and 7B are block diagrams showing embodiments of the circuit configuration for determining the state of oscillation.
Figure 7B:
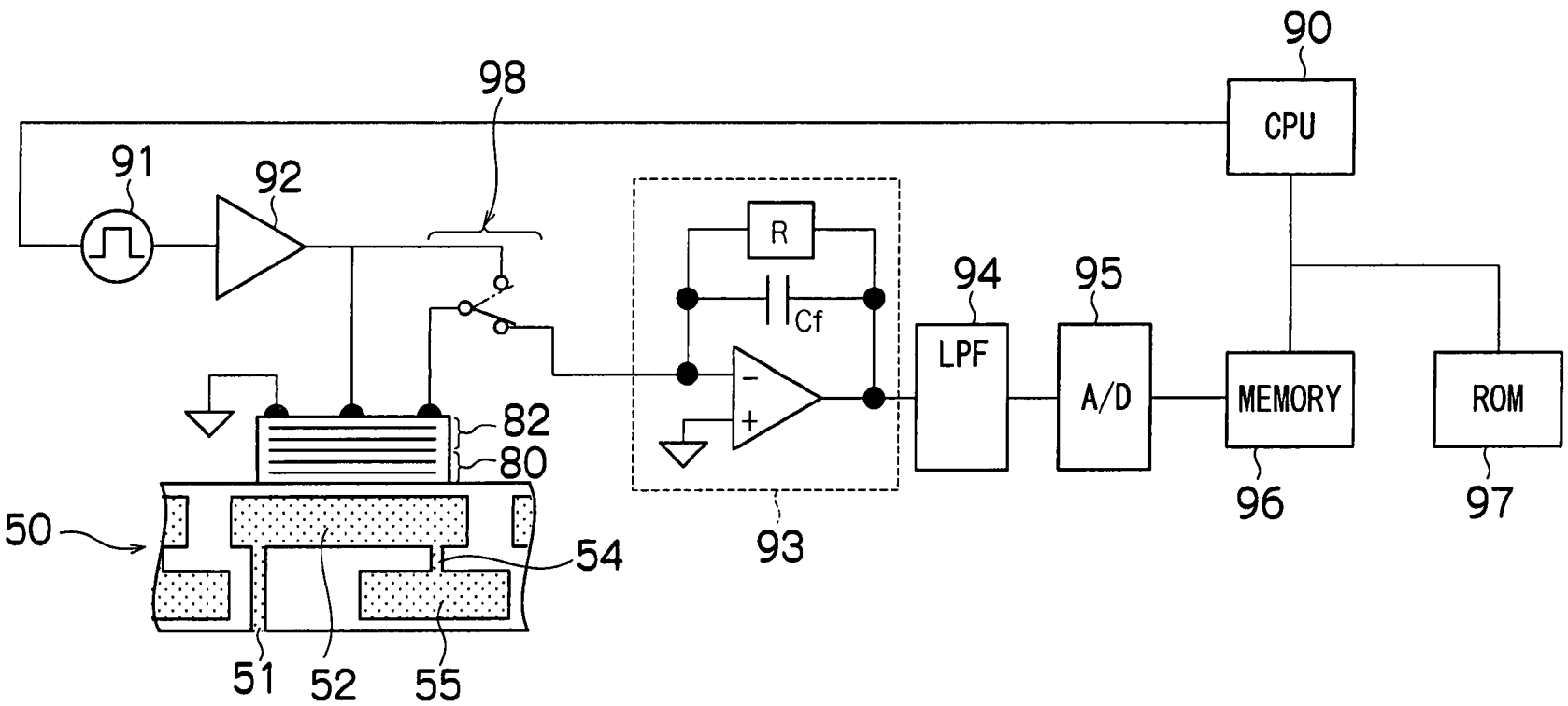

FIGS. 7A and 7B show embodiments of the circuit configuration for determining the state of oscillation upon receiving the determination signal.

The processing flow of the signal detected by the mechanoelectrical transducer 82 will now be described with reference to FIG. 7A. As shown in FIG. 7A, when the print head 50 is driven, a CPU, DSP or another such processor 90 generates a signal for driving the electromechanical transducer 80 by means of a signal generator 91. The electromechanical transducer 80 is driven by this drive signal through a drive circuit 92. As previously described, the electromechanical transducer 80 deforms due to the applied voltage that corresponds to the drive signal, the diaphragm 56 is displaced, and the capacity of the pressure chamber 52 is reduced, whereby ink is ejected from the nozzle 51.

As a result of the state of the pressure chamber 52, the diaphragm 56 oscillates and an electrical charge is generated in the mechanoelectrical transducer 82. This generated electrical charge is converted to voltage and is amplified by a signal conversion circuit 93 to a level of analog/digital (A/D) conversion.

Since low-frequency noise equivalent to a commercial power source frequency (e.g., 60 Hz or 50 Hz) is present in the signal from the mechanoelectrical transducer 82, the signal conversion circuit 93 includes a high-pass filter (HPF). Also, A/D conversion is performed through a band-pass filter (BPF) by a low-pass filter (LPF) 94 for anti-aliasing.

The signal conversion circuit 93 outputs a voltage Vout obtained by dividing the electrical charge Q inputted from the mechanoelectrical transducer 82 by the capacity Cf of the capacitor. That is, $Vout=-Q/Cf$. The cutoff frequency fc of the HPF is $fc=1/(2\pi ARCf)$ in the signal conversion circuit 93 shown in FIG. 7A.

The data converted by an A/D converter 95 is stored in a memory 96 or the like; then the data is analyzed by the processor 90 such as the CPU or DSP, and it is determined whether ejection is normally performed, and is also determined the state in a case where the ejection is abnormal.

The signal is picked up from the mechanoelectrical transducer 82 as the electrical charge in the above-described example, but it is possible to pick up the signal as voltage and to amplify the voltage. Also, explanation is made for one element above, but all the elements may be simultaneously used for determination, or the elements may be alternately used for determination by being switched with an analog multiplexer or another such switching circuit.

The oscillation cycle, attenuation cycle, and other such data for every nozzle are preferably parameterized and stored in a ROM 97, since deviations occur in the respective elements, heads, and nozzles. The ROM 97 may be mounted in the head unit.

Thus, since the piezoelectric elements for drive and the piezoelectric elements for determination have a layered structure according to the present embodiment, they can be disposed over the entire widths of the diaphragms, there is no decrease in the surface area occupied by the electromechanical transducer, the oscillation determination sensitivity of the mechanoelectrical transducer is increased, and determination is possible even while the head is being driven.

It is hence possible to perform recovery operation that corresponds to the determined state when abnormalities are detected.

As shown in FIG. 7B, a circuit switching part 98 may be arranged for switching the mechanoelectrical transducer 82, which is usually used for determination, to the driving mode. When the recovery operation is performed, the mechanoelectrical transducer 82 for determination is switched to be utilized as an additional electromechanical transducer for drive, and the drive sources are thereby enhanced, so that a preliminary ejection to eliminate clogging in the nozzles can be performed more efficiently.

Figure 8A:
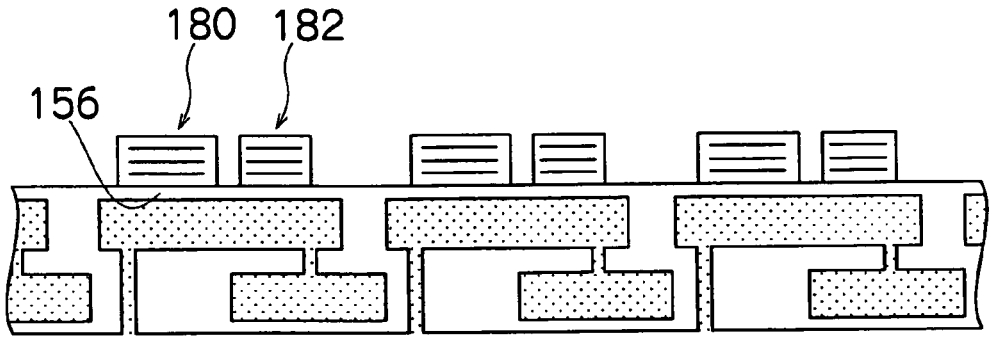
FIGS. 8A and 8B are explanatory drawings showing the state during piezoelectric element manufacturing.
Figure 8B:
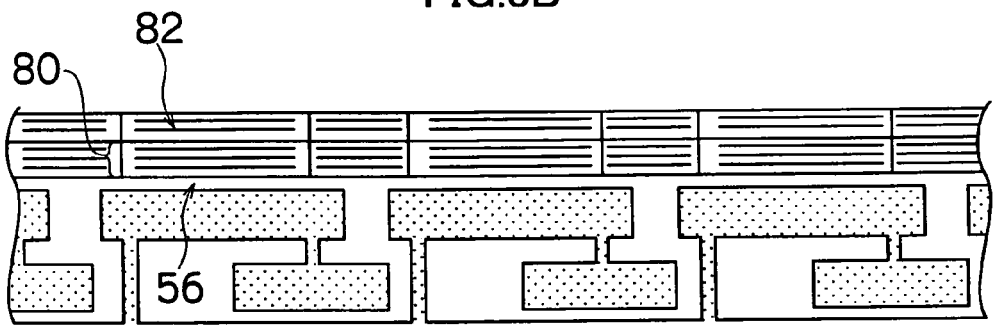

With reference to FIGS. 8A and 8B, the merits of manufacturing the piezoelectric elements that have a layered structure as in the present embodiment are described in comparison with a comparative example. FIG. 8A shows the case of comparative example, and FIG. 8B shows the case of the present embodiment.

In the comparative example, as shown in FIG. 8A, when an electromechanical transducer 180 for drive and a mechanoelectrical transducer 182 for determination are manufactured from separate materials on a diaphragm 156 on the top surface of a pressure chamber, a plurality of elements cannot be manufactured on one sheet, and the elements must be precisely affixed to predetermined locations on the diaphragm 156. Therefore, in the comparative example, variations in the affixing locations of the elements occur during the operation of affixing the elements.

On the other hand, in the case of the present embodiment shown in FIG. 8B, it is possible to manufacture a plurality of elements on a single sheet and to precisely affix the sheet to the diaphragm 56 even when the electromechanical transducer 80 for drive and the mechanoelectrical transducer 82 for determination are manufactured from different materials.

Therefore, in the case of a layered structure as in the present embodiment, variations in the affixing locations of the elements can be eliminated in the affixing operation of the single sheet.

When the piezoelectric element for drive and the piezoelectric element for determination are manufactured from the same material, a plurality of elements can be manufactured on one sheet and the sheet can be precisely affixed to the diaphragm even in the comparative example, which is the same as in the present embodiment. However, since the piezoelectric elements for drive and the piezoelectric elements determination are aligned on the diaphragm in the comparative example, the surface area occupied by the piezoelectric element for drive is reduced, which causes problems of reduced drive efficiency and the like. By contrast, the present embodiment has far superior effects aside from manufacturing also when the elements are manufacture from the same material.

Figure 9:
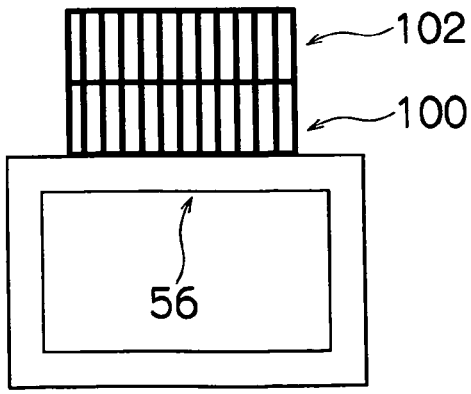
FIG. 9 is a cross-sectional view showing another method for stacking the piezoelectric elements.

Moreover, the stacking direction of all the piezoelectric elements is parallel to the diaphragm in the example described above, but an electromechanical transducer 100 for drive and a mechanoelectrical transducer 102 for determination may be stacked so as to be perpendicular to the diaphragm 56, as shown in FIG. 9.

Figure 10:
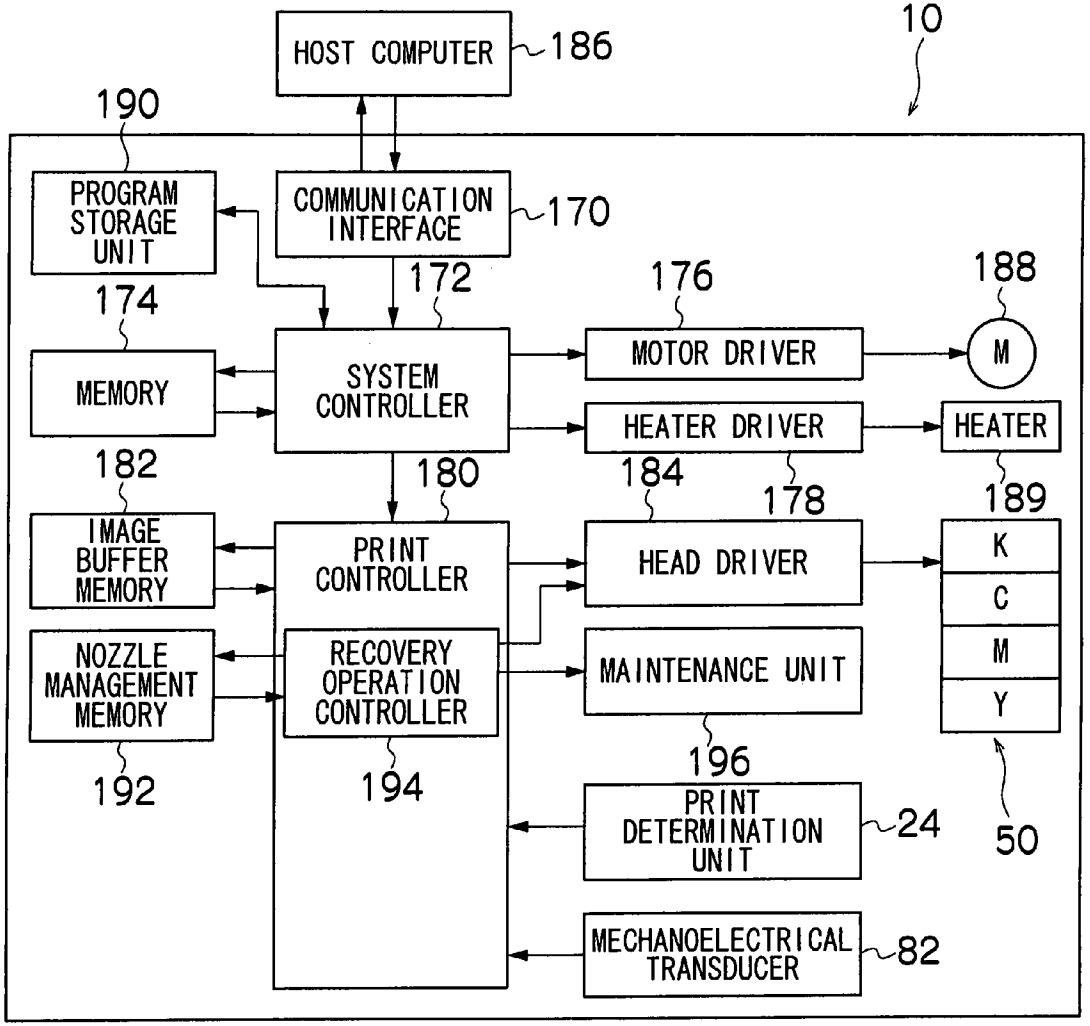
FIG. 10 is a block diagram showing the schematic system structure of the ink-jet recording apparatus.

FIG. 10 shows the system configuration of the inkjet recording apparatus 10 of the present embodiment. As shown in FIG. 10, the inkjet recording apparatus 10 comprises a communication interface 170, a system controller 172, a memory 174, a motor driver 176, a heater driver 178, a print controller 180, an image buffer memory 182, a head driver 184, and the like.

The communication interface 170 is an interface that receives image data sent from a host computer 186. A USB, IEEE 1394, Ethernet, wireless network or other serial interface, or Centronics or another parallel interface can be used as the communication interface 170. A buffer memory (not shown) for speeding up communication may be installed in this portion. The image data sent from the host computer 186 is taken into the inkjet recording apparatus 10 via the communication interface 170 and is temporarily stored in the memory 174. The memory 174 is a storage device which temporarily stores the images inputted via the communication interface 170, and data is read or written by means of the system controller 172. The memory 174 is not limited to a memory composed of semiconductor devices, and a hard disk or other such magnetic medium may be used.

The system controller 172 is a control unit that controls the communication interface 170, the memory 174, the motor driver 176, the heater driver 178, and other units according to a control program stored in a program storage unit 190. The system controller 172 is configured from a central processing unit (CPU), peripheral circuits, and the like. The controller 172 controls the communication with the host computer 186 as well as the reading and writing of the memory 174, and also generates a control signal for controlling a conveyance motor 188 and a heater 189.

The motor driver 176 is a driver (drive circuit) for driving the motor 188 according to instructions from the system controller 172. The heater driver 178 is a driver for driving the heater 189 such as the post-drying unit 42 according to instructions from the system controller 172.

The print control unit 180 is a control unit that has a signal processing function for performing process, correction, and other types of processing to generate a signal for print control from the image data in the memory 174 in accordance with the control of the system controller 172, and that supplies the resulting print control signal (print data) to the head driver 184. The required signal processing is carried out in the print control unit 180, and the ejection timing and the amount of ink droplets ejected by the print heads 50 are controlled via the head driver 184 on the basis of the print data. Thus, the desired dot size and dot arrangement can be achieved.

The print control unit 180 is provided with an image buffer memory 182; and image data, parameters, and other data are temporarily stored in the image buffer memory 182 during image data processing in the print control unit 180. FIG. 10 shows a configuration in which the image buffer memory 182 is provided to the print control unit 180, but it is also possible that the memory 174 serves a dual purpose as the image buffer memory. Another possibility is to integrate the print control unit 180 and the system controller 172 and configure them as one processor.

The head driver 184 drives the piezoelectric elements (actuators) 58 of the print heads 12K, 12C, 12M, and 12Y for the respective colors on the basis of the print data sent from the print control unit 180. The head driver 184 may include a feedback control system for maintaining the head driving conditions constant.

Also, the print control unit 180 comprises a recovery operation control unit 194, which evaluates the conditions in the pressure chamber 52 either according to the determination results of the print determination unit 24 or from wave patterns determined by the mechanoelectrical transducer 82, and performs a recovery operation on the nozzles by controlling a maintenance unit 196 according to the results of the evaluation. The history of these recovery operations and other information about the nozzles are stored and managed in a nozzle management memory 192.

The droplet ejection head and image recording apparatus according to the present invention have been described in detail above. It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A droplet ejection head, comprising:

a nozzle through which a droplet of liquid is ejected;

a pressure chamber which is connected to the nozzle and filled with the liquid to be ejected through the nozzle;

a diaphragm which defines a part of the pressure chamber;

an electromechanical transducer which is deformed to drive the diaphragm to apply pressure to the liquid inside the pressure chamber so as to cause the droplet to be ejected through the nozzle; and a mechanoelectrical transducer which determines oscillation state in the pressure chamber, wherein the electromechanical transducer and the mechanoelectrical transducer are arranged on the diaphragm to form a layered structure, wherein in the layered structure, the electromechanical transducer is arranged between an electromechanical transducer electrode and a common electrode and the mechanoelectrical transducer is arranged between a mechanoelectrical transducer electrode and the common electrode.

2. The droplet ejection head as defined in claim 1, wherein each of the electromechanical transducer and the mechanoelectrical transducer comprises a plurality of layers.

3. The droplet ejection head as defined in claim 1, wherein the electromechanical transducer and the mechanoelectrical transducer are made of the same material.

4. The droplet ejection head as defined in claim 1, wherein the electromechanical transducer and the mechanoelectrical transducer are made of different materials.

5. The droplet ejection head as defined in claim 1, further comprising a circuit-switching device which switches the mechanoelectrical transducer to be utilized as an electromechanical transducer for driving the diaphragm.

6. The droplet ejection head as defined in claim 1, further comprising an evaluation device which performs evaluation of a condition in the pressure chamber from a wave pattern determined by the mechanoelectrical transducer, wherein a recovery operation for the droplet ejection head is performed according to a result of the evaluation.

7. An image recording apparatus, comprising the droplet ejection head as defined in claim 1.

8. An image recording apparatus, comprising the droplet ejection head as defined in claim 2.

9. An image recording apparatus, comprising the droplet ejection head as defined in claim 3.

10. An image recording apparatus, comprising the droplet ejection head as defined in claim 4.

11. An image recording apparatus, comprising the droplet ejection head as defined in claim 5.

12. An image recording apparatus, comprising the droplet ejection head as defined in claim 6.

* * * * *